United States Patent [19]

Takeuchi et al.

[11] Patent Number: 4,534,809

[45] Date of Patent: Aug. 13, 1985

[54] WATER-IN-OIL EMULSION EXPLOSIVE COMPOSITION

[75] Inventors: Fumio Takeuchi; Masao Takahashi; Katsuhide Hattori; Hiroshi Sakai, all of Aichi, Japan

[73] Assignee: Nippon Oil and Fats Company Limited, Tokyo, Japan

[21] Appl. No.: 645,079

[22] Filed: Aug. 28, 1984

[30] Foreign Application Priority Data

Sep. 7, 1983 [JP] Japan ..... 58-163119

[51] Int. Cl.[3] ..... C06B 45/18

[52] U.S. Cl. ..... 149/3; 149/2; 149/5; 149/6; 149/9; 149/11; 149/21; 149/46; 149/60; 149/61; 149/110

[58] Field of Search ..... 149/3, 5, 2, 6, 9, 21, 149/11, 46, 60, 61, 110

[56] References Cited

U.S. PATENT DOCUMENTS

| | | | |
|---|---|---|---|
| 4,141,766 | 2/1979 | Cameron et al. | 149/2 |
| 4,141,767 | 2/1979 | Sudweeks et al. | 149/2 |
| 4,248,644 | 2/1981 | Healy | 149/2 |
| 4,490,195 | 12/1984 | Cooper et al. | 149/2 |

*Primary Examiner*—Stephen J. Lechert, Jr.
*Attorney, Agent, or Firm*—Parkhurst & Oliff

[57] ABSTRACT

A water-in-oil emulsion explosive composition containing specifically limited hollow microspheres consisting of neutral or weakly acidic hollow microspheres coated with a coating material has a high consistency without deteriorating its storage stability in initiation sensitivity in a small diameter cartridge, and can be safely and easily handled.

11 Claims, No Drawings

WATER-IN-OIL EMULSION EXPLOSIVE COMPOSITION

BACKGROUND OF THE INVENTION (1) Field of the Invention

The present invention relates to a water-in-oil emulsion explosive composition containing microvoids, and more particularly relates to a water-in-oil emulsion explosive composition containing specifically limited hollow microspheres as microvoids, having a high consistency without deteriorating the storage stability in initiation sensitivity in a small diameter cartridge (25 mm diameter), and being able to be easily handled in the charging at the blasting.

(2) Description of the Prior Art

There have hitherto been used various microvoids in the water-in-oil emulsion explosive composition in order to decrease the specific gravity of the explosive composition and to improve the detonation properties, such as initiation sensitivity, propagation property of detonation and the like.

The term "microvoids" herein used means hollow microspheres, bubbles formed by a foaming agent and bubbles mechanically (physically) blown into the explosive composition.

When microvoids contained in a water-in-oil emulsion explosive are bubbles, the consistency of the explosive is low, and further the bubbles disappear due to the lapse of long time, resulting in the increase of the specific gravity of the explosive and in the noticeable decrease of the detonation sensitivity of the explosive.

When microvoids contained in a water-in-oil emulsion explosive are hollow microspheres, that is, when the microvoids are inorganic hollow microspheres produced from alkaline or weakly alkaline glass, such as sodium borosilicate, sodium calcium borosilicate or the like, the alkaline or weakly alkaline glass dissolves out in water during the kneading due to its high solubility in water, and hence the resulting water-in-oil emulsion looses the balance in water-in-oil emulsion, increases its consistency, is difficult in handling and is poor in storage stability. Moreover, the cost of raw material per unit volume of the resulting emulsion explosive composition is high.

The use, as hollow microspheres, of neutral or weakly acidic hollow microspheres, such as inorganic hollow microspheres produced from, for example, shirasu (shirasu is one kind of volcanic ash); carbonaceous hollow microspheres produced from, for example, pitch; synthetic resin hollow microspheres produced from, for example, vinylidene chloride-acrylonitrile-methyl methacrylate terpolymer (hereinafter, refered to as Saran (registered trademark of the terpolymer sold by Dow Chemical Co.) or phenolic resin; and the like, results in a water-in-oil emulsion explosive composition having a low consistency, and the explosive is difficult in handling and has a poor storage stability in initiation sensitivity in a small diameter cartridge.

Further there have been proposed methods for improving the storage stability in initiation sensitivity in a small diameter cartridge (25 mm diameter) and at low temperatures of water-in-oil emulsion explosives by adding to their disperse phase a compound of metals having an atomic number of at least 13 and being other than the metals of Groups I and II of the Periodic Table, a water-soluble strontium compound or an organic builder and/or inorganic builder (inorganic acid salt, organic acid salt and chloride of ammonium, alkali metal and alkaline earth metal, a part of which may be replaced by hydrogen) in U.S. Pat. No. 3,715,247 and No. 3,765,964 and Japanese Patent Laid-open Specification No. 42,952/82 and No. 47,791/82. However, in these explosives, ones containing conventional hollow microspheres are low in consistency and are difficult in handling as well.

As for the combustible material which forms a continuous phase in a water-in-oil emulsion explosive composition, when a large amount of oil or emulsifier having a high melting point or high softening point is contained in an explosive composition or the content of the oil or emulsifier therein is adjusted, a water-in-oil emulsion explosive composition having a high consistency can be obtained. However, the use of a large amount of oil or emulsifier having a high viscosity lowers the storage stability in initiation sensitivity of the resulting water-in-oil emulsion explosive composition. While, a water-in-oil emulsion explosive composition having a low consistency, particularly a small diameter cartridge formed of the explosive composition, deforms during the transportation or deforms at the charge into a borehole to cause difficulties in the charging. That is, the explosive having a low consistency is difficult in handling, is poor in blasting effect and is often misfired and remains. Further, in a water-in-oil emulsion explosive composition containing a large amount of oil or emulsifier, particles which form the disperse phase are apt to be connected to each other or crystallized due to the lapse of time and other external factor, resulting in the breakage of the water-in-oil emulsion, and hence the explosive composition is poor in storage stability in initiation sensitivity, particularly, in a small diameter cartridge (25 mm diameter).

The inventors have made various investigations for a long period of time in order to overcome the drawbacks of water-in-oil emulsion explosive compositions containing the above described conventional hollow microspheres, and found out that the use of specifically limited hollow microspheres can produce a water-in-oil emulsion explosive composition having a high consistency without deteriorating the storage stability in initiation sensitivity in a small diameter cartridge (25 mm diameter), and hence the explosive composition can be easily handled. As the result, the present invention has been accomplished.

SUMMARY OF THE INVENTION

The feature of the present invention lies in a water-in-oil emulsion explosive composition containing micrvoids, the improvement comprising the microvoids being neutral or weakly acidic hollow microspheres coated with at least one coating material selected from the group consisting of inorganic acid salts, organic acid salts and chlorides of ammonium, alkali metal or alkaline earth metal, which ammonium, alkali metal or alkaline earth metal may be partly replaced by hydrogen.

DESCRIPTION OF THE PREFERRED EMBODIMENT

The neutral or weakly acidic hollow microspheres constituting the specifically limited hollow microspheres to be used in the present invention includes inorganic hollow microspheres obtained from, for example, shirasu (shirasu is one kind of volcanic ash), volcanic rock, alumina, perlite, obsidian, shale, fly ash and the like; carbonaceous hollow microspheres obtained from, for example, pitch, coal, fired product of phenolic hollow microspheres, and the like; synthetic resin hollow microspheres obtained from, for example, vinylidene chloride-acrylonitrilemethyl methacrylate terpolymer (registered trademark: Saran), phenolic resin, epoxy resin, urea resin and the like; and the like. These hollow microspheres are used alone or in admixture.

As the coating material constituting the specifically limited hollow microspheres to be used in the present invention, use is made of inorganic acid salt, organic acid salt and chloride of ammonium, alkali metal or alkaline earth metal, which ammonium, alkali metal and alkaline earth metal may be partly replaced by hydrogen; and concretely inorganic acid salts, such a borate, carbonate, phosphate, silicate, sulfate and the like, organic acid salts, such as acetate, citrate, tartarate, gluconate, oxalate, polyacrylate, L-glutamate, naphthalenesulfonate and the like, and chloride and the like of ammonium, lithium, sodium, potassium, copper, baryllium, magnesium, calcium, zinc, strontium, and barium, which ammonium and metal may be partly replaced by hydrogen.

In the present invention, the coating material is used alone or in admixture. The compounding amount of the coating material is 0.1–100% by weight, preferably 0.2–80% by weight, based on the amount of the above described neutral or weakly acidic hollow microspheres.

Further, the compounding amount of the coating material is 0.005–7% by weight, preferably 0.01–5% by weight, based on the total amount of the resulting water-in-oil emulsion explosive composition. When the compounding amount of the coating material is less then 0.1% by weight based on the amount of the neutral or weakly acidic hollow microspheres, or less then 0.005% by weight based on the total amount of the water-in-oil emulsion explosive composition, the effect of the present invention can not be fully attained. When the compounding amount of the coating material is more than 100% by weight based on the amount of the neutral or weakly acidic hollow microspheres or more than 7% by weight based on the total amount of the water-in-oil emulsion explosive composition, the explosive composition is poor in the strength and is expensive in its raw material.

The average particle size of the specifically limited hollow microspheres to be used in the present invention should be 10–1,000 μm, and is preferably 20–800 μm, and the density thereof should be 0.007–0.7 g/cc and is preferably 0.01–0.5 g/cc. When the average particle size is less than 10 μm, the effect of the present invention can not be fully attained, and when the average particle size is more than 1,000 μm, the resulting explosive composition has a low detonation velocity and is poor in storage stability in initiation sensitivity in a small diameter cartridge (25 mm diameter). When the density of the specifically limited hollow microspheres is less than 0.007 g/cc, the hollow microspheres are difficult to be mixed with a water-in-oil emulsion, resulting in a water-in-oil emulsion explosive composition having a poor strength. When the density of the specifically limited hollow microspheres is higher than 0.7 g/cc, the compounding amount of the hollow microspheres must be increased in order to maintain the initiation sensitivity of the resulting water-in-oil emulsion explosive composition. In this case, when inorganic hollow microspheres are used, the explosive composition is poor in strength, and when carbonaceous or synthetic resin hollow microspheres are used, the explosive composition has a negative oxygen balance and is poor in after-detonation fume. The compounding amount of the specifically limited hollow microspheres is 0.05–10% by weight, preferably 0.1–8% by weight, based on the total amount of the resulting water-in-oil emulsion explosive composition. When the compounding amount of the specifically limited hollow microspheres is less than 0.05% by weight, the effect of the present invention can not fully attained, and when the amount is more that 10% by weight, the resulting explosive composition is poor in strength and is disadvantageous in view of the cost of raw materials.

The water-in-oil emulsion explosive composition of the present invention comprises, for example, a disperse phase formed of an aqueous oxidizer salt solution consisting of 40–90% by weight of an inorganic oxidizer salt, which consists mainly of ammonium nitrate, and 7.45–28% by weight of water; a continuous phase formed of a combustible material, which consists of 1–10% by weight of oil, such as microcrystalline wax, paraffin wax or the like, having a melting point or softening point higher than room temperature; 0.5–5% by weight of an emulsifier and 0.05–10% by weight of specifically limited hollow microspheres.

Hereinafter, a typical method of producing the specifically limited hollow microspheres to be used in the present invention will be explained.

Neutral or weakly acidic hollow microspheres are immersed in an aqueous solution of a coating material defined in the present invention, and stirred therein for a given time. The resulting means was filtered and dried to obtain specifically limited hollow microspheres. The resulting specifically limited hollow microspheres are used in place of conventional microvoids, and a water-in-oil emulsion explosive is produced by a commonly known method.

The following examples are given for the purpose of illustration of this invention and are not intended as limitations thereof. Production methods of specifically limited hollow microspheres used in the Examples are explained in Reference examples. In the examples, "parts" and "%" mean by weight.

REFERENCE EXAMPLE 1

Into 4 l of a 1% aqueous solution of sodium tetraborate to be used as a coating material defined in the present invention was immersed 200 g of inorganic hollow microspheres (trademark: Silica Balloon SPW-7, sold by Kushiro Sekitan Kanryu Co.) consisting of neutral or weakly acidic hollow microspheres of shirasu, and was gently stirred therein for about 5 minutes to adhere fully the coating material to the surface of the Silica Balloon SPW-7. Then, the above treated Silica Balloon SPW-7 was filtered and heated at 50–80° C. to obtain Silica Balloon SPW-7 coated with sodium tetraborate (hereinafter, referred to as silica balloons (1)). The resulting hollow microspheres had an average particle size of 60 μm and a density of 0.19 g/cc.

REFERENCE EXAMPLES 2–8

Hollow microspheres were produced in the same manner as described in Reference example 1, except that, in place of sodium tetraborate used in Reference example 1, potassium phosphate was used (Reference example 2, Silica Balloon SPW-7 coated with potassium phosphate is referred to as silica balloons (2)), sodium polyacrylate was used (Reference example 3, Silica Balloon SPW-7 coated with sodium polyacrylate is referred to as silica balloons (3)), sodium L-glutamate was used (Reference example 4, Silica Balloon SPW-7 coated with sodium L-glutamate is referred to as silica balloons (4)); and in place of sodium tetraborate and Silica Balloon SPW-7 used in Reference example 1, calcium acetate and carbonaceous hollow microspheres (trademark: Kureka Sphere A-200, sold by Kureha Chemical Industry Co., Ltd.) made of pitch were used (Reference example 5, Kureka Sphere A-200 coated with calcium acetate is referred to as carbon balloons (5)), strontium carbonate and Kureka Sphere A-200 were used (Reference example 6, Kuraka Sphere A-200 coated with strontium carbonate is referred to as carbon balloons (6)), sodium citrate and synthetic resin hollow microspheres (trademark: Expancel, sold by Kemanord Co., Ltd.) made of Saran were used (Reference example 7, Expancel coated with sodium citrate is referred to as Saran balloons (7)), and potassium chloride and Expancel were used (Reference example 8, Expancel coated with potassium chloride is referred to as Saran balloons (8)).

The average particle size and density of the resulting hollow microspheres are shown in the following Table 1.

TABLE 1

| Reference example | Hollow microspheres Material | Trademark | Coating material | Specifically limited hollow microspheres Average particle size (μm) | Density (g/cc) | Abbreviated name |
|---|---|---|---|---|---|---|
| 1 | shirasu | Silica Balloon SPW-7 | sodium tetraborate | 60 | 0.19 | silica ballons (1) |
| 2 | " | Silica Balloon SPW-7 | potassium phosphate | 60 | 0.20 | silica balloons (2) |
| 3 | " | Silica Balloon SPW-7 | sodium polyacrylate | 60 | 0.20 | silica balloons (3) |
| 4 | " | Silica Balloon SPW-7 | sodium L-glutamate | 60 | 0.19 | silica balloons (4) |
| 5 | pitch | Kureka Sphere A-200 | calcium acetate | 230 | 0.32 | carbon balloons (5) |
| 6 | " | Kureka Sphere A-200 | strontium carbonate | 230 | 0.31 | carbon balloons (6) |
| 7 | saran | Expancel | sodium citrate | 40 | 0.08 | Saran balloons (7) |
| 8 | " | " | potassium chloride | 40 | 0.09 | Saran balloons (8) |

EXAMPLES 1-6

A water-in-oil emulsion explosive composition having a compounding recipe shown in Examples 1-6 in the following Table 2 was produced in the following manner.

To 10.89 parts of water were added 75.2 parts of ammonium nitrate and 4.51 parts of sodium nitrate, and the resulting mixture was heated to dissolve the nitrates in water and to obtain an aqueous oxidizer salt solution kept at about 90° C. A mixture of 3.36 parts of microcrystalline was (m.p. 155° F.) and 1.73 parts of sorbitan monooleate was heated and melted to obtain a combustible material mixture kept at about 90° C.

Into a heat-insulating vessel was charged the above described combustible material mixture, and then the above described aqueous oxidizer salt solution was gradually added thereto while agitating the resulting mixture by means of a propeller blade-type agitator. After completion of the addition, the resulting mixture was further agitated at a rate of about 1,600 rpm for 5 minutes to obtain a water-in-oil emulsion kept at about 80° C. Then, the water-in-oil emulsion was mixed with a given amount of the hollow microspheres obtained in Reference examples 1-4 or a mixture thereof in a kneader to obtain a water-in-oil emulsion explosive composition. The resulting water-in-oil emulsion explosive composition was molded into a shaped article having a diameter of 25 mm and having a weight of 100 g, and the shaped article was packed with a viscose-processed paper to form a cartridge, which was used in the following performance tests:

(A) measurement of density (g/cc) after one day from the production;

(B) measurement of stiffners by needle-penetration (mm), wherein an iron conical needle (apex 30°) having a weight of 133 g was dropped from a height of 45 mm on a sample explosive, and the penetration value (mm) of the needle into the explosive was measured; and (C) storage stability test for initiation sensitivity, wherein such a temperature cycle that a sample cartridge was kept at 60° C. for 24 hours and then at −15° C. for 24 hours was repeated to deteriorate forcedly the sample cartridge, initiation tests of the above treated sample cartridge were effected at −5° C. by using a No. 6 blasting cap during the repeating temperature cycles until the sample cartridge was no longer detonated, and the number of the repeated temperature cycles was measured and estimated to be the number of months, within which the sample cartridge was able to be storaged at room temperature (10-30° C.) while maintaining its complete detonability (this estimation is based on the experimental data that the above described one temperature cycle corresponds substantially to one month storage at room temperature). The obtained results are shown in Table 2.

EXAMPLE 7

A water-in-oil emulsion explosive composition was produced in the same manner as described in Example 1, except that calcium nitrate was used in place of sodium nitrate, paraffin wax (m.p. 125° F.) was used in place of microcrystalline wax (m.p. 155 ° F.) and glycerol monostearate was used in place of sorbitan monooleate. A cartridge was produced from the resulting water-in-oil emulsion explosive composition, and subjected to the same performance tests as described in Example 1. The obtained results are shown in Table 2.

EXAMPLES 8-13

A water-in-oil emulsion was produced in the same manner as described in Example 1, and mixed with a given amount of each or a mixture of hollow microspheres obtained in Reference examples 5-8 by means of a kneader to obtain water-in-oil emulsion explosive compositions. A cartridge was produced from each of the resulting explosive compositions in the same manner as described in Example 1, and subjected to the same performance tests as described in Example 1. The obtained results are shown in Table 2.

EXAMPLE 14

A water-in-oil emulsion explosive composition was produced in the same manner as described in Example 8, except that calcium nitrate was used in place of sodium nitrate, paraffin wax (m.p. 125° F.) was used in place of microcrystalline wax (m.p. 155° F.), and glycerol monostearate was used in place of sorbitan monooleate. A cartridge was produced from the resulting water-in-oil emulsion explosive composition in the same manner as described in Example 1, and subjected to the same performance tests as described in Example 1. The obtained results are shown in Table 2.

Into a heat-insulating vessel was charged the above described combustible material mixture, and then the aqueous oxidizer salt solution was gradually added to the combustible material mixture while agitating the resulting mixture by means of a propellet blade-type agitator. After completion of the addition, the resulting mixture was further agitated at a rate of about 1,600 rpm for 5 minutes to obtain a water-in-oil emulsion kept at about 85° C. Finally, the water-in-oil emulsion was mixed with 4.06 parts of commonly known silica balloons by means of a kneader to obtain a water-in-oil emulsion explosive composition. A cartridge was produced from the resulting water-in-oil emulsion explosive composition in the same manner as described in Example 1, and subjected to the same performance tests as described in Example 1. The obtained results are shown in Table 3.

COMPARATIVE EXAMPLES 2-5

Water-in-oil emulsion explosive compositions were produced in the same manner as described in Comparative example 1, except that sodium tetraborate used in Comparative example 1 was replaced by potassium phosphate, sodium polyacrylate, sodium L-glutamate or a mixture of sodium tetraborate and potassium phosphate. A cartridge was produced from each of the resulting water-in-oil emulsion explosive compositions in the same manner as described in Example 1, and subjected to the same performance tests as described in Example 1. The obtained results are shown Table 3.

TABLE 2

| Example | | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| Ammonium nitrate | | | | 75.20 | | | 73.51 | 75.20 | | 73.87 | | 78.03 | | 77.72 | 78.03 |
| Sodium nitrate | | | | 4.51 | | | 4.41 | — | | 4.43 | | 4.68 | | 4.66 | — |
| Calcium nitrate | | | | — | | | — | 4.51 | | — | | — | | — | 4.68 |
| Water | | | | 10.89 | | | 10.64 | 10.89 | | 10.70 | | 11.30 | | 11.25 | 11.30 |
| 155° F. (68° C.) microcrystalline wax | | | | 3.36 | | | 3.28 | — | | 3.30 | | 3.49 | | 3.48 | — |
| 125° F. (52° C.) paraffin wax | | | | — | | | — | 3.36 | | — | | — | | — | 3.49 |
| Sorbitan monooleate | | | | 1.73 | | | 1.69 | — | | 1.70 | | 1.80 | | 1.79 | — |
| Glycerol monostearate | | | | — | | | — | 1.73 | | — | | — | | — | 1.80 |
| Silica balloons (1) | | 4.31 | — | — | — | 2.16 | 6.47 | 4.31 | — | — | — | — | — | — | — |
| Silica balloons (2) | | — | 4.31 | — | — | 2.15 | — | — | — | — | — | — | — | — | — |
| Silica balloons (3) | | — | — | 4.31 | — | — | — | — | — | — | — | — | — | — | — |
| Silica balloons (4) | | — | — | — | 4.31 | — | — | — | — | — | — | — | — | — | — |
| Carbon balloons (5) | | — | — | — | — | — | — | — | 6.0 | — | — | — | — | — | — |
| Carbon balloons (6) | | — | — | — | — | — | — | — | — | 6.0 | — | — | — | — | — |
| Saran balloons (7) | | — | — | — | — | — | — | — | — | — | 0.7 | — | 0.35 | 1.10 | 0.70 |
| Saran balloons (8) | | — | — | — | — | — | — | — | — | — | — | 0.7 | 0.35 | — | — |
| After one day from production | Density (g/cc) | 1.07 | 1.06 | 1.08 | 1.07 | 1.07 | 0.97 | 1.08 | 1.08 | 1.07 | 1.08 | 1.09 | 1.09 | 0.98 | 1.08 |
| | Penetration value of needle (mm) | 13 | 14 | 13 | 13 | 13 | 12 | 14 | 14 | 13 | 14 | 14 | 14 | 13 | 14 |
| Storage stability in initiation sensitivity (Number of storage months while maintaining complete detonability) | | 21 | 22 | 22 | 20 | 22 | 27 | 19 | 21 | 20 | 23 | 24 | 23 | 29 | 21 |

COMPARATIVE EXAMPLE 1

A water-in-oil emulsion explosive composition having a compounding recipe shown in the following Table 3 was produced in the following manner.

To 10.89 parts of water were added 75.20 parts of ammonium nitrate, 4.51 parts of sodium nitrate and 0.25 part of sodium tetraborate, and the resulting mixture was heated to dissolve the compounds in water and to obtain an aqueous oxidizer salt solution kept at about 90° C. A mixture of 3.36 parts of microcrystalline wax (m.p. 155° F.) and 1.73 parts of sorbitan monooleate was heated and melted to obtain a combustible material mixture kept at about 90° C.

COMPARATIVE EXAMPLES 6-10

Water-in-oil emulsion explosive compositions were produced in the following compounding recipe according to Comparative example 1. That is, in Comparative example 6, sodium tetraborate was omitted from the compounding recipe of comparative example 1. In Comparative example 7, in place of microcrystalline wax (m.p. 155° F.) in the compounding recipe of Comparative example 6, microcrystalline wax (m.p. 180° F.) was used. In Comparative Example 8, in place of microcrystalline wax (m.p. 155° F.) in the compounding recipe of Comparative example 6, paraffin wax (m.p. 160° F.) was used. In Comparative example 9, in place of silica balloons in the compounding recipe of Comparative example 6, glass balloons were used. In Comparative example 10, the ratio of microcrystalline wax (m.p. 155° F.) to sorbitan monooleate in the compounding recipe of Comparative example 6 was varied from about 2:1 to about 3:1. A cartridge was produced from each of the resulting water-in-oil emulsion explosive compositions in the same manner as described in Example 1, and subjected to the same performance tests as described in Example 1. The obtained results are shown in Table 3.

COMPARATIVE EXAMPLES 11 and 12

Water-in-oil emulsion explosive compositions were produced in the same manner as described in Comparative example 1, except the following. In Comparative example 11, sodium borate and silica balloons were used in amounts larger than those used in Comparative example 1. In Comparative example 12, sodium tetraborate was not used, but silica balloons were used in a larger amount. A cartridge was produced from each of the resulting water-in-oil emulsion explosive compositions in the same manner as described in Example 1 and subjected to the same performance tests as described in Example 1. The obtained results are shown in Table 3.

COMPARATIVE EXAMPLES 13 and 14

Water-in-oil emulsion explosive compositions were produced in the same manner as described in Comparative example 1, except the following. In Comparative example 13, in place of sodium nitrate, microcrystalline wax (m.p. 155° F.) and sorbitan monooleate used in Comparative example 1, calcium nitrate, paraffin wax (m.p. 125° F.) and glycerol monostearate were used, respectively. In Comparative example 14, in place of sodium nitrate, microcrystalline wax (m.p. 155° F.) and sorbitan monooleate used in Comparative example 1, calcium nitrate, parafin wax (m.p. 125° F.) and glycerol monostearate were used respectively, and sodium tetraborate was not used. A cartridge was produced from each of the resulting water-in-oil emulsion explosive compositions in the same manner as described in Example 1, and subjected to the same performance tests to the same performance tests as described in Example 1. The obtained results are shown in Table 3.

COMPARATIVE EXAMPLES 15–21

Water-in-oil emulsion explosive compositions were produced in the same manner as described in Comparative example 1, except that, in place of sodium tetraborate and silica balloons used in Comparative example 1, calcium acetate and carbon balloons were used (Comparative example 15), strontium carbonate and carbon balloons were used (Comparative example 16), carbon balloons were used (Comparative example 17), sodium citrate and Saran balloons were used (Comparative example 18), potassium chloride and Saran balloons were used (Comparative Example 19), a mixture of sodium citrate and potassium chloride and Saran balloons were used (Comparative example 20), and Saran balloons were used (Comparative example 21). A cartridge was produced from each of resulting water-in-oil emulsion explosive compositions in the same manner as described in Example 1, and subjected to the same performance tests as described in Example 1. The obtained results are shown in Table 4.

COMPARATIVE EXAMPLES 22 and 23

Water-in-oil emulsion explosive compositions were produced in the same manner as described in Comparative example 18, except that the amounts of calcium acetate and Saran balloons in the compounding recipe of Comparative example 18 were increased (Comparative example 22), or calcium acetate was omitted from the compounding recipe of Comparative example 18, but the amount of Saran balloons was increased (Comparative example 23). A cartridge was produced from each of the resulting water-in-oil emulsion explosive compositions in the same manner as described in Example 1, and subjected to the same performance tests as described in Example 1. The obtained results are shown in Table 4.

COMPARATIVE EXAMPLES 24 and 25

Water-in-oil emulsion explosive compositions were produced in the same manner as described in Comparative example 18 except that, in place of sodium nitrate, microcrystallin wax and sorbitan monooleate used in Comaprative example 18, calcium nitrate, paraffin wax and glycerol monostearate were used, respectively (Comparative example 24); calcium nitrate, paraffin wax and glycerol monostearate were used respectively, and further sodium citrate was omitted from the compounding recipe (Comparative example 25). A cartridge was produced from each of the resulting water-in-oil emulsion explosive compositions in the same manner as described in Example 1, and subjected to the same performance tests as described in Example 1. The obtained results are shown in Table 4.

TABLE 3

| Comparative example | | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| Ammonium nitrate | | | | | | 75.20 | | | | | | 73.51 | | 75.20 | |
| Sodium nitrate | | | | | | 4.51 | | | | | | 4.41 | | — | |
| Calcium nitrate | | | | | | — | | | | | | — | | 4.51 | |
| Water | | | | | | 10.89 | | | | | | 10.64 | | 10.89 | |
| Sodium tetraborate | | 0.25 | — | — | — | 0.13 | — | — | — | — | — | 0.38 | — | 0.25 | — |
| Potassium phosphate | | — | 0.25 | — | — | 0.12 | — | — | — | — | — | — | — | — | — |
| Sodium polyacrylate | | — | — | 0.25 | — | — | — | — | — | — | — | — | — | — | — |
| Sodium L-glutamate | | — | — | — | 0.25 | — | — | — | — | — | — | — | — | — | — |
| 155° F. (68° C.) microcrystalline wax | | 3.36 | 3.36 | 3.36 | 3.36 | 3.36 | 3.36 | — | — | 3.36 | 3.82 | 3.28 | 3.28 | — | — |
| 180° F. (82° C.) microcrystalline wax | | — | — | — | — | — | — | 3.36 | — | — | — | — | — | — | — |
| 125° F. (52° C.) paraffin wax | | — | — | — | — | — | — | — | — | — | — | — | — | 3.36 | 3.36 |
| 160° F. (71° C.) paraffin wax | | — | — | — | — | — | — | — | 3.36 | — | — | — | — | — | — |
| Sorbitan monooleate | | 1.73 | 1.73 | 1.73 | 1.73 | 1.73 | 1.73 | 1.73 | 1.73 | 1.73 | 1.27 | 1.69 | 1.69 | — | — |
| Glycerol monostearate | | — | — | — | — | — | — | — | — | — | — | — | — | 1.73 | 1.73 |
| Silica balloons | | 4.06 | 4.06 | 4.06 | 4.06 | 4.06 | 4.31 | 4.31 | 4.31 | — | 4.31 | 6.09 | 6.47 | 4.06 | 4.31 |
| Glass balloons | | — | — | — | — | — | — | — | — | 4.31 | — | — | — | — | — |
| Carbon balloons | | — | — | — | — | — | — | — | — | — | — | — | — | — | — |
| Saran balloons | | — | — | — | — | — | — | — | — | — | — | — | — | — | — |
| After one day | Density (g/cc) | 1.08 | 1.07 | 1.07 | 1.09 | 1.08 | 1.04 | 1.05 | 1.04 | 1.00 | 1.05 | 0.99 | 0.96 | 1.09 | 1.07 |
| from production | Penetration value | 19 | 18 | 18 | 18 | 19 | 18 | 14 | 15 | 18 | 13 | 18 | 18 | 19 | 20 |

TABLE 3-continued

| Comparative example | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| of needle (mm) | | | | | | | | | | | | | | |
| Storage stability in initiation sensitivity (Number of storage months while maintaining complete detonability) | 20 | 18 | 19 | 20 | 21 | 13 | 9 | 9 | 18 | 7 | 24 | 18 | 17 | 12 |

Note:
silica ballons: Silica Balloon SPW-7 (sold by Kushiro Sekitan Kanryu Co.), average particle size: 60 μm, density: 0.18 g/cc.
glass balloons: Glass Bubble B15/250 (sold by Minnesota Mining Manufacturing Co.), average particle size: 80 μm, density: 0.15 g/cc.
carbon balloons: Kureka Sphere (sold by Kureha Chemical Industry Co., Ltd.), average particle size: 230 μm, density: 0.30 g/cc.
Saran balloons: Expancel (sold by Kemanord Co., Ltd.), average particle size: 40 μm, density: 0.04 g/cc.

TABLE 4

| Comparative example | | 15 | 16 | 17 | 18 | 19 | 20 | 21 | 22 | 23 | 24 | 25 |
|---|---|---|---|---|---|---|---|---|---|---|---|---|
| Ammonium nitrate | | | 73.87 | | | 78.03 | | | 77.72 | | 78.03 | |
| Sodium nitrate | | | 4.43 | | | 4.68 | | | 4.66 | | — | |
| Calcium nitrate | | | — | | | — | | | — | | 4.68 | |
| Water | | | 10.70 | | | 11.30 | | | 11.25 | | 11.30 | |
| Calcium acetate | | 0.1 | — | — | — | — | — | — | — | — | — | — |
| Strontium carbonate | | — | 0.1 | — | — | — | — | — | — | — | — | — |
| Sodium citrate | | — | — | — | 0.1 | — | 0.15 | — | 0.05 | — | 0.1 | — |
| Potassium chloride | | — | — | — | — | 0.1 | 0.05 | — | — | — | — | — |
| 155° F. (68° C.) microcrystalline wax | | 3.30 | 3.30 | 3.30 | 3.49 | 3.49 | 3.49 | 3.49 | 3.48 | 3.48 | — | — |
| 125° F. (52° C.) paraffin wax | | — | — | — | — | — | — | — | — | — | 3.49 | 3.49 |
| Sorbitan monooleate | | 1.70 | 1.70 | 1.70 | 1.80 | 1.80 | 1.80 | 1.80 | 1.79 | 1.79 | — | — |
| Glycerol monostearate | | — | — | — | — | — | — | — | — | — | 1.80 | 1.80 |
| Silica balloons | | — | — | — | — | — | — | — | — | — | — | — |
| Glass balloons | | — | — | — | — | — | — | — | — | — | — | — |
| Carbon balloons | | 5.9 | 5.9 | 6.0 | — | — | — | — | — | — | — | — |
| Saran balloons | | — | — | — | 0.60 | 0.60 | 0.60 | 0.70 | 0.95 | 1.10 | 0.60 | 0.70 |
| After one day from production | Density (g/cc) | 1.09 | 1.10 | 1.11 | 1.10 | 1.09 | 1.11 | 1.10 | 0.97 | 0.95 | 1.10 | 1.08 |
| | Penetration value of needle (mm) | 20 | 20 | 19 | 19 | 20 | 18 | 21 | 19 | 19 | 21 | 20 |
| Storage stability in initiation sensitivity (Number of storage months while maintaining complete detonability) | | 19 | 20 | 13 | 21 | 22 | 21 | 15 | 28 | 19 | 19 | 14 |

Note:
silica balloons, glass balloons, carbon balloons and Saran balloons are the same as those used in Table 3.

It can be seen from the results of the above experiments that, in spite of the fact that the water-in-oil emulsion explosive compositions containing the specifically limited hollow microspheres according to the present invention (refer to Table 2) have a storage life of as long as 19–20 months in a storage stability test for initiation sensitivity, within which the explosive composition can be completely detonated, the explosive compositions have a stiffness (penetration value of needle) of 12–14 mm. On the contrary, although the water-in-oil emulsion explosive compositions containing commonly known hollow microspheres have a storage life of 12–28 months in a storage stability test for initiation sensitivity, within which the explosive composition can be completely detonated, the explosive compositions have a stiffness (penetration value of needle) of 19–21 mm. Conventional water-in-oil emulsion compositions containing commonly known hollow microspheres having a stiffness (penetration value of needle) of 13 mm, 14 mm or 15 mm have a very short storage life of9,9 or 6 months respectively in a storage stability test for initiation sensitivity, within which the explosive composition can be completely detonated (Comparative examples 7, 8 and 9).

As described above, the water-in-oil emulsion explosive composition containing the specifically limited hollow microspheres according to the present invention has a consistency higher than that of water-in-oil emulsion explosive compositions containing commonly known hollow microspheres without deteriorating the storage stability in initiation sensitivity in a small diameter cartridge (25 mm diameter), and hence the explosive composition can be remarkably easily handled as compared with conventional water-in-oil emulsion explosive composition.

What is claimed is:

1. In a water-in-oil emulsion explosive composition containing microvoids, the improvement comprising said microvoids being neutral or weakly acidic hollow microspheres coated with at least one coating material selected from the group consisting of inorganic acid salts, organic acid salts and chlorides of ammonium, alkali metal or alkaline earth metal which ammonium, alkali metal or alkaline earth metal may be partly replaced by hydrogen.

2. A water-in-oil emulsion explosive composition according to claim 1, wherein said inorganic acid salt is at least one member selected from the group consisting of borate, carbonate, phosphate, silicate and sulfate.

3. A water-in-oil emulsion explosive composition according to claim 1, wherein said organic acid salt is at least one member selected from the group consisting of acetate, citrate, tartarate, L-gluconate, oxalate, polyacrylate, L-glutamate and naphthalenesulfonate.

4. A water-in-oil emulsion explosive composition according to claim 1, wherein said hollow microspheres coated with a coating material have an average particle size of 10–1,000 μm and a density of 0.007–0.7 g/cc.

5. A water-in-oil emulsion explosive composition according to claim 1, wherein said neutral or weakly acidic hollow microspheres are one member selected from the group consisting of inorganic hollow microspheres, carbonaceous hollow microspheres and synthetic resin hollow microspheres.

6. A water-in-oil emulsion explosive composition according to claim 5, wherein said inorganic hollow microspheres are one member selected from the group consisting of shirasu, volcanic rock, alumina, perlite, obsidian, shale and fly ash.

7. A water-in-oil emulsion explosive composition according to claim 5, wherein said carbonaceous hollow microspheres are one member selected from the group consisting of pitch, coal and calcined product of phenolic resin hollow microspheres.

8. A water-in-oil emulsion explosive composition according to claim 5, wherein said synthetic resin hollow microspheres are one member selected from the group consisting of vinylidene chloride-acrylonitrile-methyl methacrylate terpolymer, phenolic resin, epoxy resin and urea resin.

9. A water-in-oil emulsion explosive composition according to claim 1, wherein the compounding amount of the hollow microspheres coated with a coating material is 0.05–10% by weight based on the total amount of the explosive composition.

10. A water-in-oil emulsion explosive composition according to claim 1, wherein the explosive composition comprises a disperse phase formed of an aqueous oxidizer salt solution consisting of 40–90% by weight of an inorganic oxidizer salt and 7.45–28% by weight of water; a continuous phase formed of a combustible material consisting of 1–10% by weight of an oil; 0.5–5% by weight of an emulsifier; and 0.05–10% by weight of hollow microspheres coated with a coating material.

11. A water-in-oil emulsion explosive composition according to claim 10, wherein said inorganic oxidizer sait consists mainly of ammonium nitrate.

* * * * *